US007229345B2

(12) United States Patent
Fierus et al.

(10) Patent No.: US 7,229,345 B2
(45) Date of Patent: Jun. 12, 2007

(54) KNIFE SHARPENER

(75) Inventors: Udo Fierus, Leverkusen (DE); Gerd Fierus, Odenthal (DE)

(73) Assignee: Flugel CSS GmbH & Co., KG (DE)

( * ) Notice: Subject to any disclaimer, the term of this patent is extended or adjusted under 35 U.S.C. 154(b) by 0 days.

(21) Appl. No.: 11/062,529

(22) Filed: Feb. 22, 2005

(65) Prior Publication Data

US 2005/0197053 A1 Sep. 8, 2005

(30) Foreign Application Priority Data

Feb. 21, 2004 (DE) ..... 20 2004 002 773 U
Apr. 30, 2004 (DE) ..... 20 2004 006 957 U

(51) Int. Cl.
*B24B 19/00* (2006.01)

(52) U.S. Cl. ..... 451/523; 451/556; 76/82; 76/84

(58) Field of Classification Search ..... 451/523, 451/519, 552, 490, 555, 556; 76/81, 81.7, 76/82, 84, 85, 88, 89
See application file for complete search history.

(56) References Cited

U.S. PATENT DOCUMENTS 3,011,366 A * 12/1961 Sandven et al. ..... 76/82
4,197,677 A * 4/1980 Graves ..... 451/555
4,285,253 A * 8/1981 Edling ..... 76/84
4,759,153 A * 7/1988 Cohen ..... 451/45
5,700,189 A * 12/1997 Farris ..... 451/555
5,976,002 A * 11/1999 Keough ..... 451/556
6,048,262 A * 4/2000 Ray ..... 451/555
6,454,642 B1 * 9/2002 Fierus et al. ..... 451/519
6,547,656 B1 * 4/2003 LeVine ..... 451/524
6,572,448 B1 * 6/2003 Bauer ..... 451/29
2004/0116055 A1 * 6/2004 Friel ..... 451/293

FOREIGN PATENT DOCUMENTS

| | | |
|---|---|---|
| DE | 89 04 608 | 6/1989 |
| DE | 198 54 496 | 12/1999 |
| DE | 20 2004 002 773 | 6/2004 |
| WO | WO 00/30811 | 6/2000 |

* cited by examiner

*Primary Examiner*—Jacob K. Ackun, Jr.
(74) *Attorney, Agent, or Firm*—Cantor Colburn LLP

(57) ABSTRACT

The invention concerns a knife sharpener for household knives or the like. In order to design a knife sharpener, which, one the one hand, can be used for sharpening and sits solidly on a surface without it having to be held, and which, on the other hand, is producible with little economic cost regarding production and assembly, the invention proposes a knife sharpener with a housing, which has a surface designed to be a base, and at least one longitudinal, cylindrical grinding element made from ceramics, at least part of the surface of which is arranged on the surface of the housing, whereas the base is designed at a right angle to a longitudinal line of the grinding element and the grinding element is positioned in the middle in relation to a projection of the base.

12 Claims, 8 Drawing Sheets

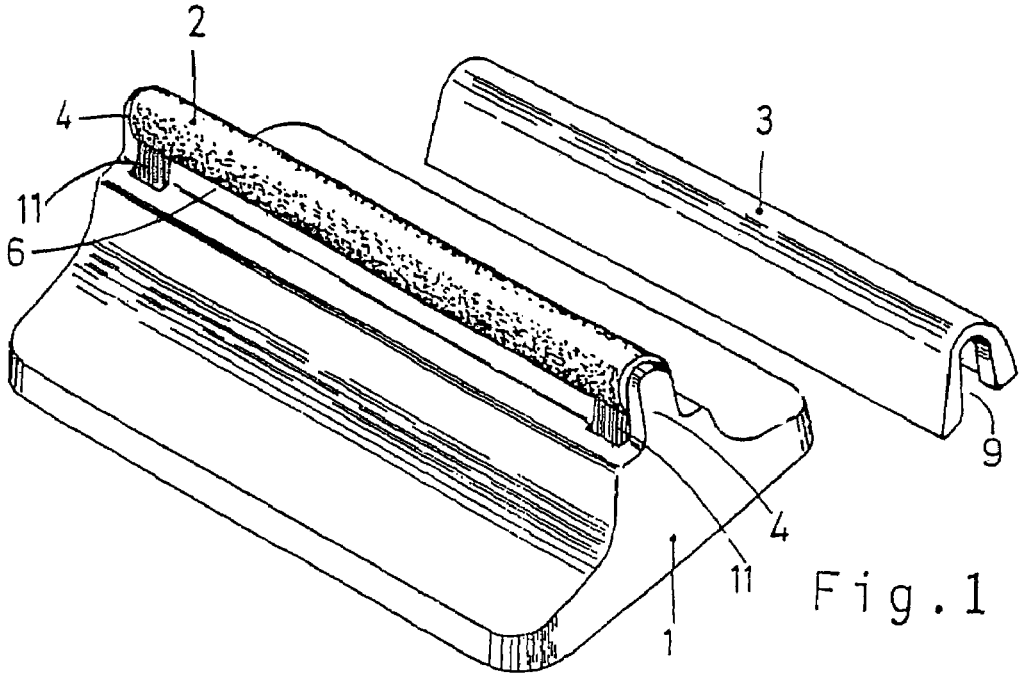
Fig. 1
Fig. 2
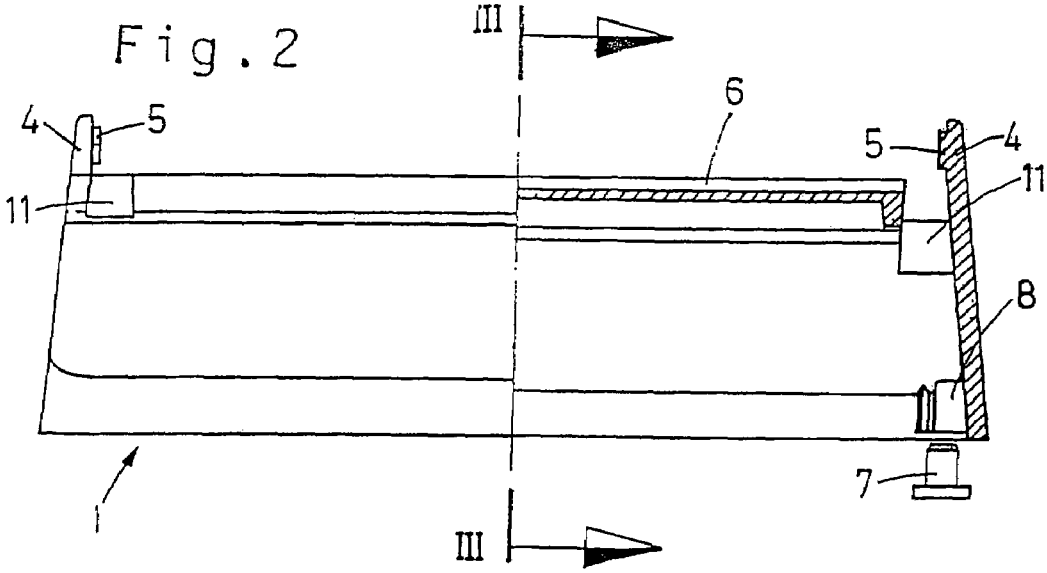
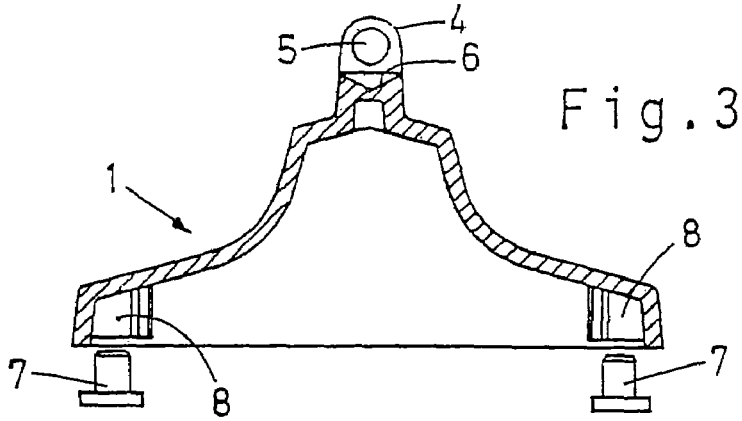
Fig. 3

Fig. 4
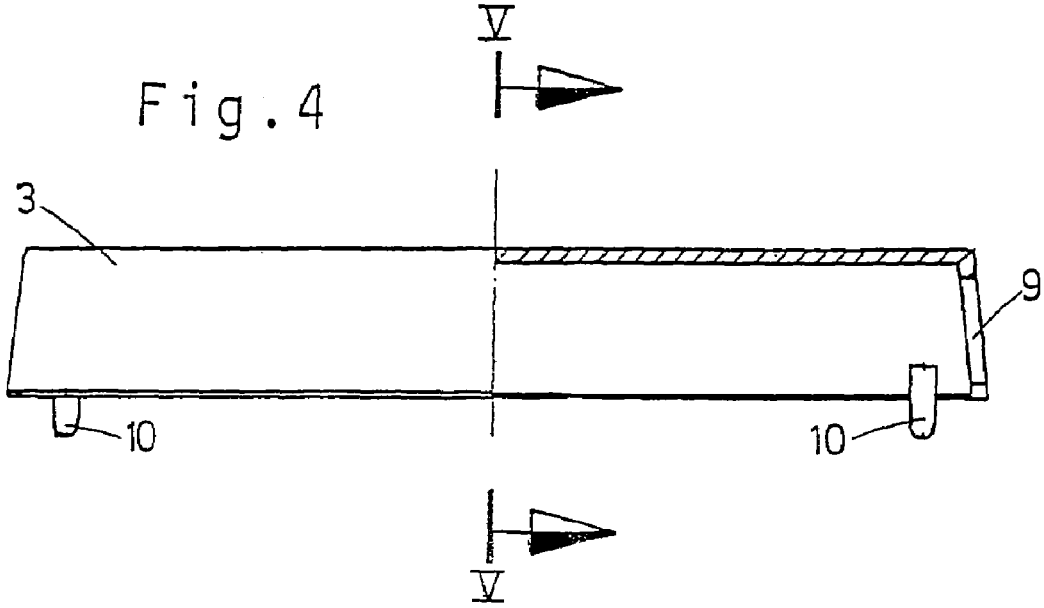
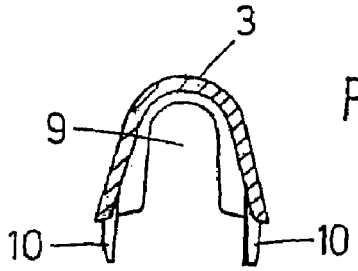
Fig. 5
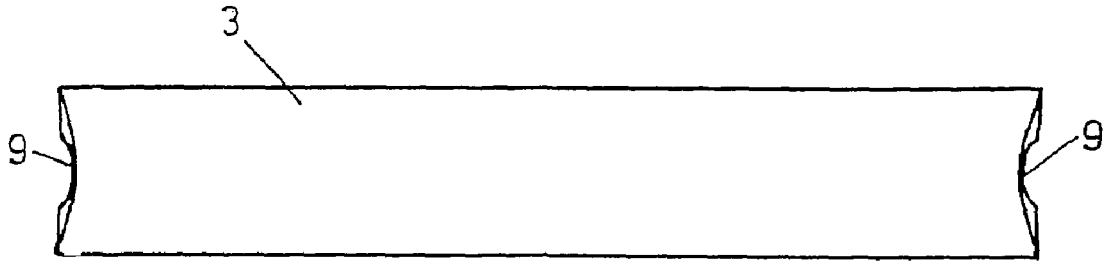
Fig. 6

KNIFE SHARPENER

TECHNICAL FIELD OF INVENTION

The invention concerns a knife sharpener for kitchen knives or such.

BRIEF DESCRIPTION OF RELATED ART

There are knife sharpeners of many types and modes of operation. For example, there are knife sharpeners which correspond to the classical sharpening steel. These sharpeners consist of a handle and a grinding rod made of steel or ceramics. The handle can be provided with a hand guard so that untrained users are protected from injuries.

There are also knife sharpeners that are fixed as floor-mounted appliances on a work bench or such. The user generally has to hold it with one hand while sharpening the blade of the knife on a grinding tool made, for example, of steel or ceramic materials, applying more or less pressure.

The disadvantage with previously known knife sharpeners is that people do not like to use them since they are afraid of injuring themselves. Also, people generally object to sharpeners due to its weapon- or tool-like nature.

Furthermore, knife sharpeners are quite invariable regarding design, very expensive and time-consuming as far as production, assembly and operation are concerned. During the production the grinding tool and handles, casings, and such are designed separately from one another according to ergonomic factors. This design allows for little variability. From an economical standpoint, the handles, casings and such have to be adapted to the functional design of the grinding tool.

BRIEF SUMMARY OF THE INVENTION the present invention provides a knife sharpener that on the one hand can be used for sharpening while being mounted on a substrate without the user having to hold on to it. Beyond that, regarding external styling and design, the knife sharpener should be quite variable and, regarding production and assembly, producible with little economic expense.

A knife sharpener with characteristics of claim 1 is proposed for accomplishing the objective.

In accordance with the present invention, the knife sharpener is characterized by the casing being designed with a wide base compared to the grinding tool, and a simple grinding tool retainer. This can be, for example, a plastic injection-molded part, which can also be made of a single piece.

Basically cylindrical ceramic rods come into consideration as grinding elements which can also be hollow cylinders in accordance with an advantageous proposal of the invention.

The incorporation of the grinding element in the surface opposite the base takes place in such a way that it is in the middle in relation to the comparatively wide base. In this way, it is guaranteed that moving a knife beyond the grinding element surface will not tip the knife sharpener.

Incorporating the grinding element can take place in various simple ways. For example, the primarily cylindrical grinding element can be inserted in between two elastic supporting arms, preferably with its end regions.

Receivers can also be constructed in the housing, for example, boreholes or such, in which the ends of the grinding element can be inserted. Advantageously, mounting the grinding element will occur in a way that allows the grinding element to be at least slightly movable. In this case, the grinding element will be supported from below by spring devices. The advantage of this is that a knife placed on the grinding element will absorb some of the pressure. On the other hand, the grinding element is always held in an upper position. This results in flexible adaptation, so that the grinding element always lies against, for example, concave or convex cutting edge shapes.

Advantageously, the primarily cylindrical grinding element can be rotated, so that different parts of the surface are used for the sharpening of knives. It goes without saying that the grinding element can not be rotated while sharpening a knife. The grinding element can either be rotated by hand, by corresponding operating devices or the like.

The simplest design of the knife sharpener comprises a plastic injection molded housing made in a single piece with the arms above it and an inserted cylindrical grinding element.

A more expensive design might feature two, three or more grinding elements arranged parallel to one another, which would practically provide one grinding surface. In this case the base should not be designed too wide opposite to the surface of the grinding element, since the tilting effect is absorbed by the surface. Even rectangular casings are appropriate in this case. This embodiment with its broad base and a grinding element is inventive and capable of protection in dependence independently from the previously described simpler design. It is a knife sharpener, in which the surface of the grinding element and the base are similar to the simpler design, the casing therefore having a cuboid shape. Since there are two, three, or more parallel grinding elements, the pressure is absorbed by a greater surface, and the knife sharpener is prevented from tipping over.

The invention makes available knife sharpeners that can be produced with little economic expense, be used with one hand and are quite variable regarding design configuration.

Advantageously, the knife sharpener can be equipped with protective caps that cover the horizontal surfaces of the grinding elements.

During the sharpening process, the knife is passed across the grinding element with one hand, with the aid of the second hand for better guidance with bigger knives, at an angle of, for example, 20° from both sides. If necessary, the grinding element can be rotated manually after the sharpening, so that it is not worn out on one side, and its entire circumference can be used.

Due to its simplicity, it can be assumed with this sharpening process that faulty operation and possible risk of injury are largely ruled out.

BRIEF DESCRIPTION OF THE DRAWINGS

Further advantages and characteristics of the invention will become apparent in the following description on the basis of the figures, wherein:

FIG. 1: Illustrates the knife sharpener with the cover taken off in the use position in perspective, FIG. 2: Illustrates in half longitudinal section in side view of the knife sharpener housing, FIG. 3: Illustrates a cross section according to line III—III in FIG. 2, FIG. 4: Illustrates in half longitudinal the knife sharpener's cap, FIG. 5: Illustrates a section through the cap according to line V—V in FIG. 4, FIG. 6: Illustrates a top view of the protective cap.

DETAILED DESCRIPTION OF THE INVENTION

Figure 7:
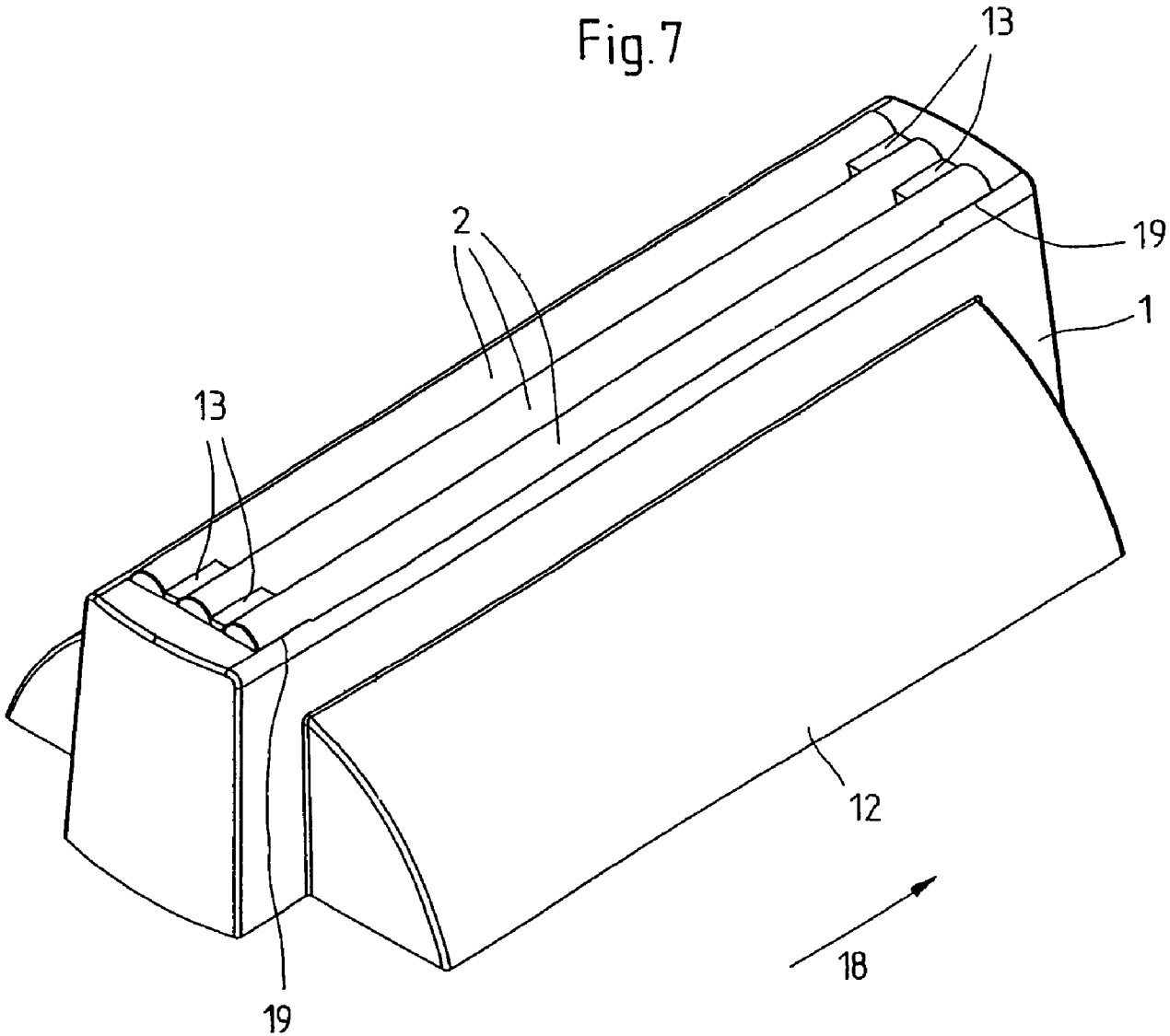
FIG. 7: Illustrates the knife sharpener of the invention in a second embodiment, according to which the knife sharpener has three grinding elements.

The knife sharpener represented consists primarily of an injection molded plastic housing 1 made in one piece with a large base, a ceramic grinding element 2, and a protective cover 3, which is seen taken off in FIG. 1, showing the knife sharpener on a table or other work bench ready to be used.

FIG. 2 shows a half longitudinal section of the housing 1 by itself from the front. There are two arms 4 with one hole on both sides of the housing, in between which the grinding element 2, as seen in FIG. 1, is loosely inserted. Grinding element 2 is a hollow ceramic cylinder, whereby short studs 5 of the supporting arms 4 are inserted into the ends of the same, which are somewhat elastically pliable, in a way that grinding element 2 rests against supporting arms 4 with some friction, but can be turned by hand, if required, in order to use another area of the grinding element's circumference for sharpening household knives or such, if the previously used area of the circumference has been dirtied by polishing wear. Grinding element 2 can be cleaned easily, however. In order to prevent penetration of grinding element 2 during sharpening, it is seated solidly on a V-shaped support plate 6 formed by housing 1. There are anti-slip bases 7 made, for example from rubber, that ensure the slip and standing stability of the knife sharpener that are inserted into the boreholes of the sockets 8 on the four corners of housing 1 and can be seen in FIGS. 2 and 3. The anti-slip bases 7 slightly protrude downward from sockets 8 of housing 1 in order to ensure a secure positioning of the housing 1 in the operating state.

FIGS. 4 to 6 show different views or sections of protective cap 3. Protective cap 3 is adjusted to the shape of the knife sharpener, as one can easily imagine in FIG. 1 when cap 3 is put on housing 1 over grinding element 2. The ends of the protective cap are equipped with the appropriate recesses 9 for the arms 4 and has four plugs 10 (FIGS. 4 and 5), which engage in pairs when cap 3 is put on to the apertures 11 of housing 1 near the supporting arms 4. The grinding element 2 is protected and not visible when protective cap 3 is on.

The knife sharpener, which, for example, has a base of about 128×80 mm and a height of about 45 mm, does not require a lot of room and is therefore space-saving, but can also be erected visibly when not being used, since it has a pleasant external appearance.

FIGS. 7 to 11 show the second embodiment of the knife sharpener in accordance with the invention. Unlike the embodiment seen in FIGS. 1 to 6, the second embodiment of the knife sharpener as seen in FIGS. 7 to 11 has three grinding elements 2 which are parallel to one another. Grinding elements 2 are preferably ceramic cylinders or also hollow cylinders, which, as shown in FIGS. 1 to 6, are located in a revolving fashion in housing 1.

In order to enlarge the base, housing parts 12 are arranged to the side of housing 1, as seen in the design in FIGS. 7 to 11. Housing 1 and housing parts 12 can be made of a single piece of material. Housing parts 12 can also be separate components that are connected to housing 1, for example, glued or screwed on. The housing parts 12 are extended lengthwise in longitudinal direction 18; this basically corresponds to grinding element 2. It goes without saying, however, that the housing parts 12 can also have a greater or shorter extension in longitudinal direction 18. The only important thing here is that the total base of the knife sharpener is expanded through the additional assembly of the housing parts 12. In the examples shown in FIGS. 7 to 11, the topside of the housing parts 12 facing the base are curving. This is of course only an example, since it goes without saying that the topside of the housing parts 12 can be arranged differently.

Figure 8:
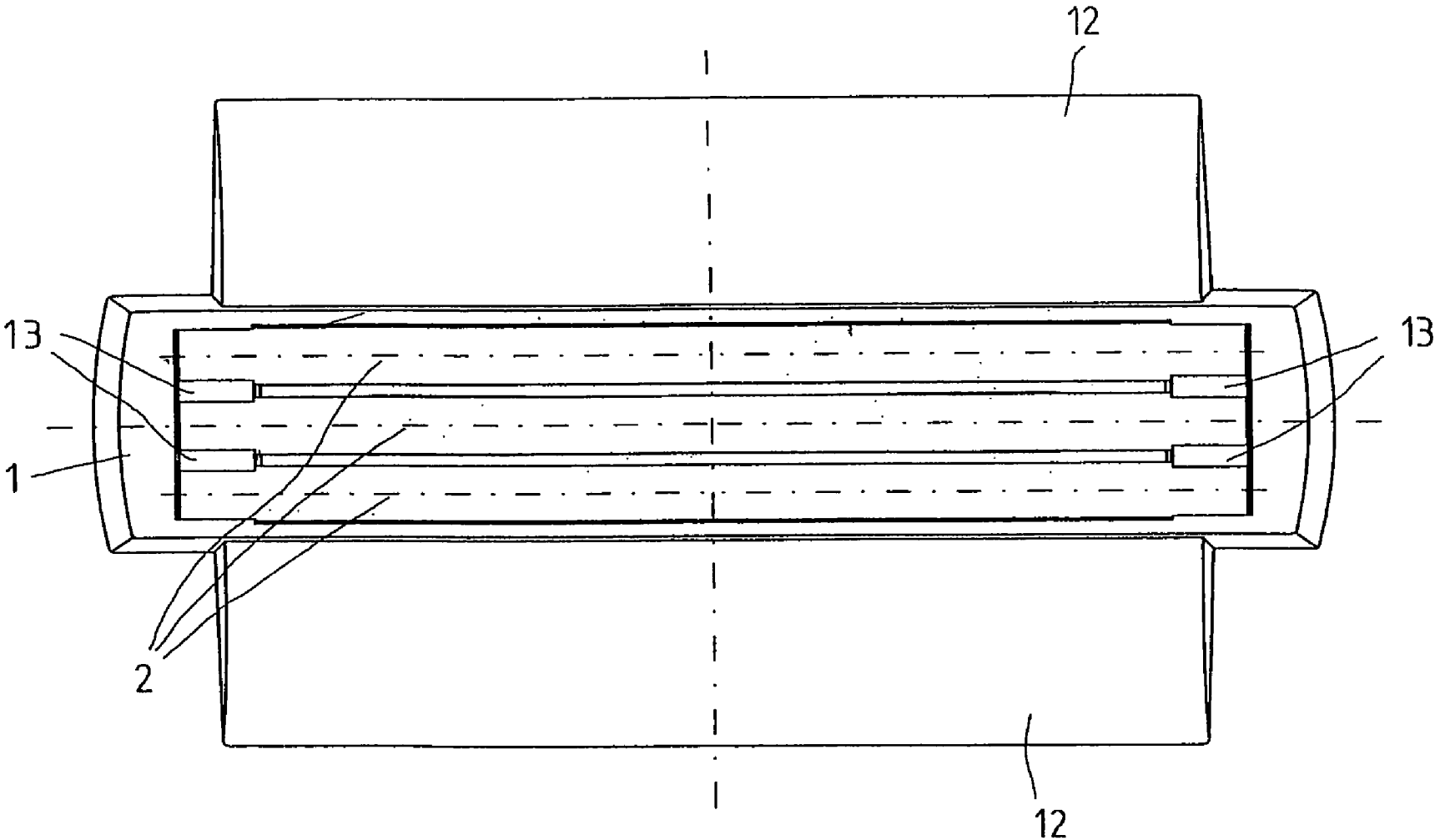
FIG. 8: Illustrates the knife sharpener according to FIG. 7 in top view.
Figure 9:
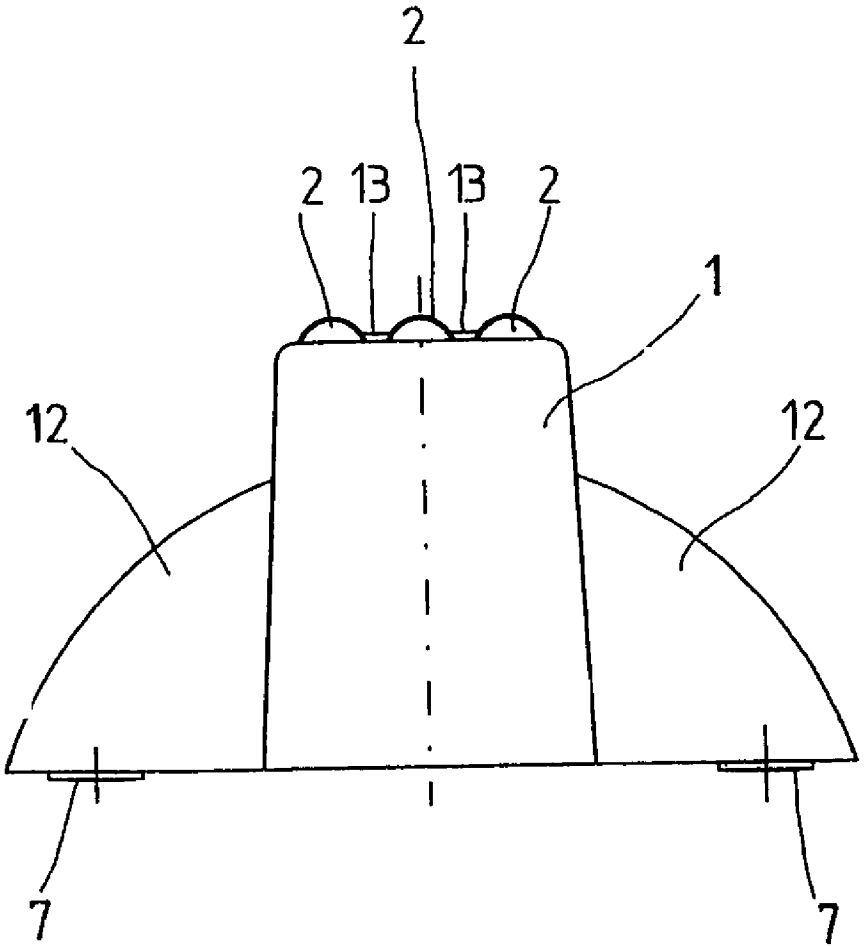
FIG. 9: Illustrates the knife sharpener according to FIG. 7 in an elevation.

The expansion of the knife sharpener's base achieved through the additional assembly of housing parts 12 can be seen particularly in FIGS. 8 and 9. The base can be expanded in a direction diagonal to longitudinal direction 18 through assembly of the housing parts 12. The expansion of the knife sharpener's base particularly allows for the sharpening of a knife, a pair of scissors or such with grinding element 2 in a direction diagonal to longitudinal direction 18 of the knife sharpener. Consequently, housing parts 12 cause the knife sharpener to be more stable, particularly in view of the strength required in sharpening diagonal to longitudinal direction 18.

Figure 10:
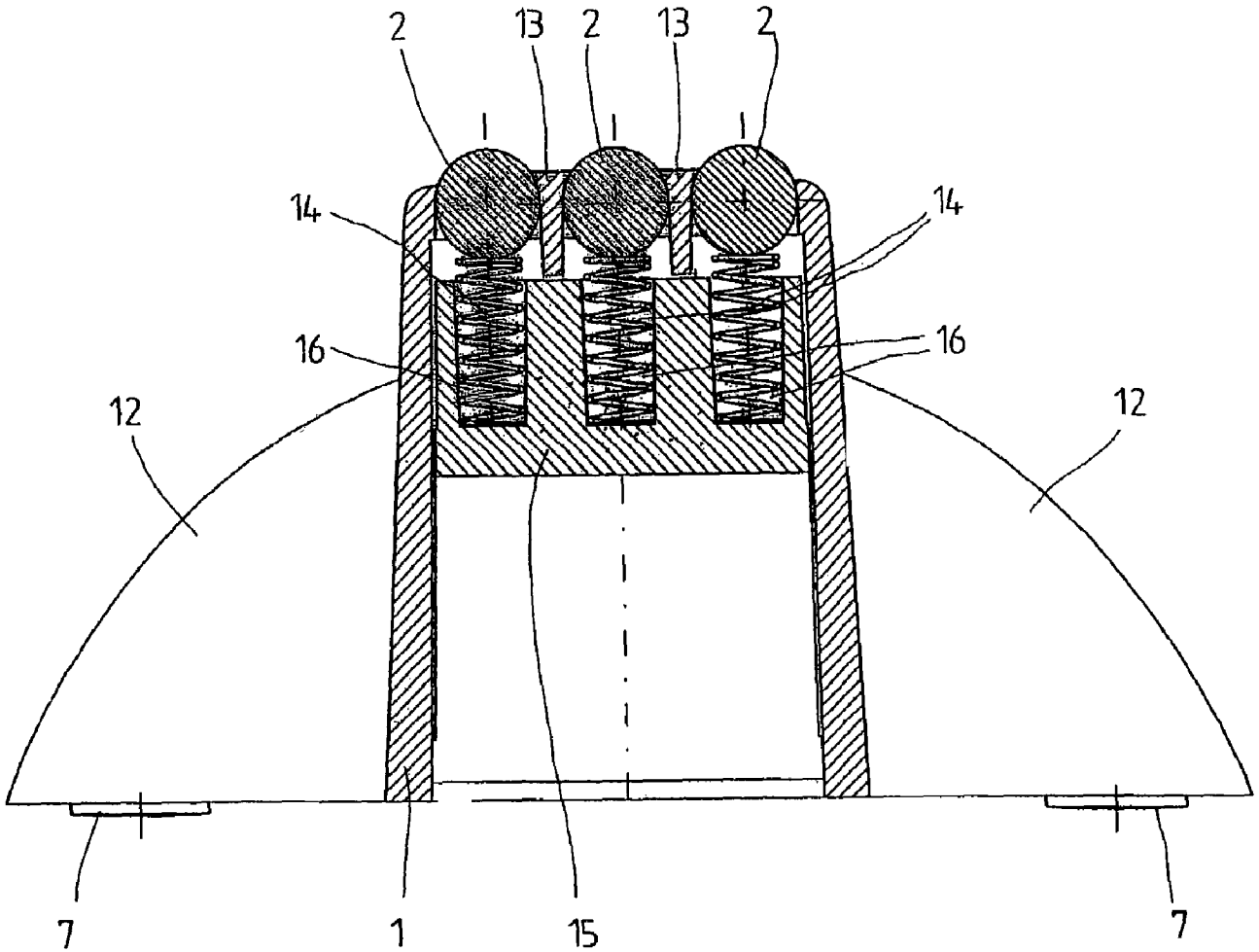
FIG. 10: Illustrates the knife sharpener according to FIG. 7 in a cutaway side view.
Figure 11:
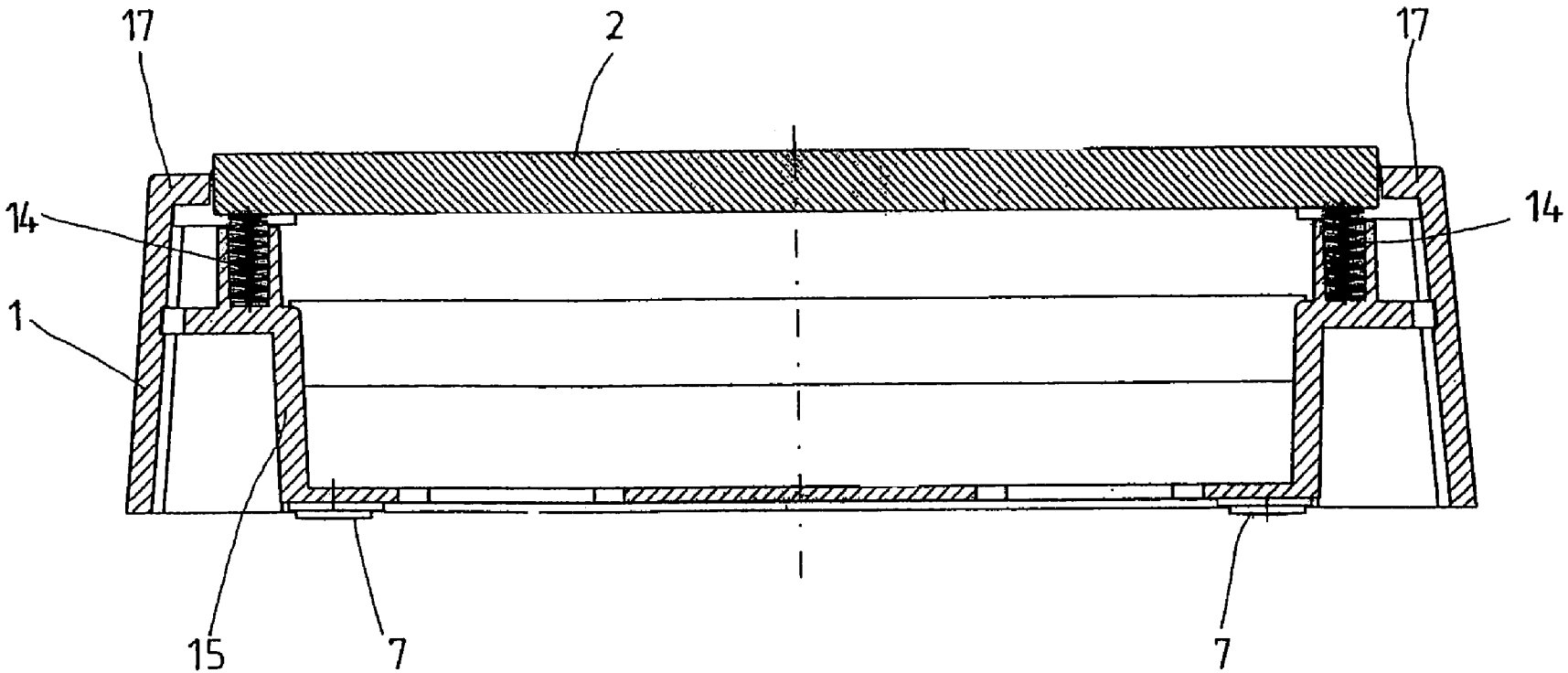
FIG. 11: Illustrates the knife sharpener according to FIG. 7 in longitudinal section

As can be seen particularly in FIGS. 10 and 11, the three grinding elements 2 are carried by a retaining element 15 inside of housing 1. Retaining element 15 has recesses 16 at its ends, in which pressure springs 14, preferably in the form of coil springs, are inserted. The springs 14 on their part carry the grinding elements 2, which are pressed to the rear side of housing 1 through the pressure impact of the springs 14. Housing 1 has a cut on the topside through which parts of the grinding elements 2 protrude, as can be seen particularly in FIG. 10. According to the described design, the grinding elements 2 are supported on the one hand by housing 1 and on the other hand by the springs 14. Through this design the grinding elements 2 are fixed securely within housing 1.

The spring tension of the springs 14 is designed in a way that the grinding elements 2 do not rotate when the knife to be sharpened is passed across the grinding elements 2. If necessary, the grinding elements 2 can be rotated manually, i.e. by hand which has the advantage that the entire circumference of the grinding elements 2 can be used. For this reason the spring tension of the springs 14 is designed in a way that the grinding elements 2 can be slightly pushed downward by hand against the spring tension, i.e. in the direction of housing 1 and subsequently twisted by their longitudinal axis.

The housing 1 is equipped with laterally arranged prolongations 17 for secure support of the grinding elements 2, as can be seen particularly in FIG. 11. These prolongations 17 make sure that the grinding elements 2 are safely secured and supported in longitudinal direction 18. Processes 17 prevent unintentional moving of the grinding elements 2 in longitudinal direction 18.

The range spacers 13 provide secure support of the grinding elements 2 in a direction diagonal to longitudinal direction 18, as can be seen in FIGS. 8 and 10. The range spacers 13 make sure that the grinding elements 2 always have the same separation distance between them in diagonal direction.

The range spacers 13 also serve a counter bearing. As can be seen in FIG. 10, the top of the range spacers 13 are broadened in vertical direction and their contour adapted to the cylindrical shape of the grinding elements 2. When the knife sharpener is assembled, the grinding elements 2 are pushed against the upper end of the spacers 13 due to the spring tension, which provides for secure support of the grinding elements 2. As can be seen in FIG. 10, the grinding element 2 in the middle is pushed against the range spacers 13 in that area on the left and right sides. The left and the right grinding element 2 are pushed against the housing 1 and against the range spacer 13 on the other side of the respective grinding element 2. The range spacers 13 then fulfill two functions (described above). On the one hand they provide support for the grinding elements 2 in vertical direction, i.e. against spring tension, on the other hand they provide a separation distance between the grinding elements 2 in diagonal direction. The spacers 13 can be a part of the housing 1 or they can be glued, screwed, fused, or attached in any other way to housing 1.

For the purpose of assembly of the knife sharpener in accordance with the present invention according to the design seen in FIGS. 7 to 11, the first step is to insert the grinding elements 2 into the housing 1 from below. Advantageously, for this reason the housing 1 is held downward head-first, so that the grinding elements 2 are held in place securely by the spacers 13 and the housing in the border area due to their weight. Thereupon, retaining element 15 is inserted into housing 1 from below; the springs 14 are located in the recesses 16. The retaining element 15 fits into housing 1 in its intended position where the grinding elements 2 are seated solidly on the springs 14 and are pushed against the range spacers 13 or and housing in that area due to the spring tension of the springs 14. If the retaining element is fitted inside of housing 1, it can be flipped and be put down on a support for intended use.

The embodiment in FIGS. 7 to 11 uses three grinding elements 2. It goes without saying that aforementioned design can of course have more than just three grinding elements 2. It is also possible to have less than three grinding elements 2.

As seen in FIG. 7, the processes 19, which are located in housing 1, support the spring-loaded grinding elements 2. It goes without saying that this design is only an example, since other constructions can be chosen, such as for example the construction that features a guide rail along the entire length of longitudinal direction 18. It is crucial that the grinding elements 2 are pushed against the appropriate counter bearing by the spring tension of the springs 14, which securely supports the grinding elements 2 in their position.

Figure 12:
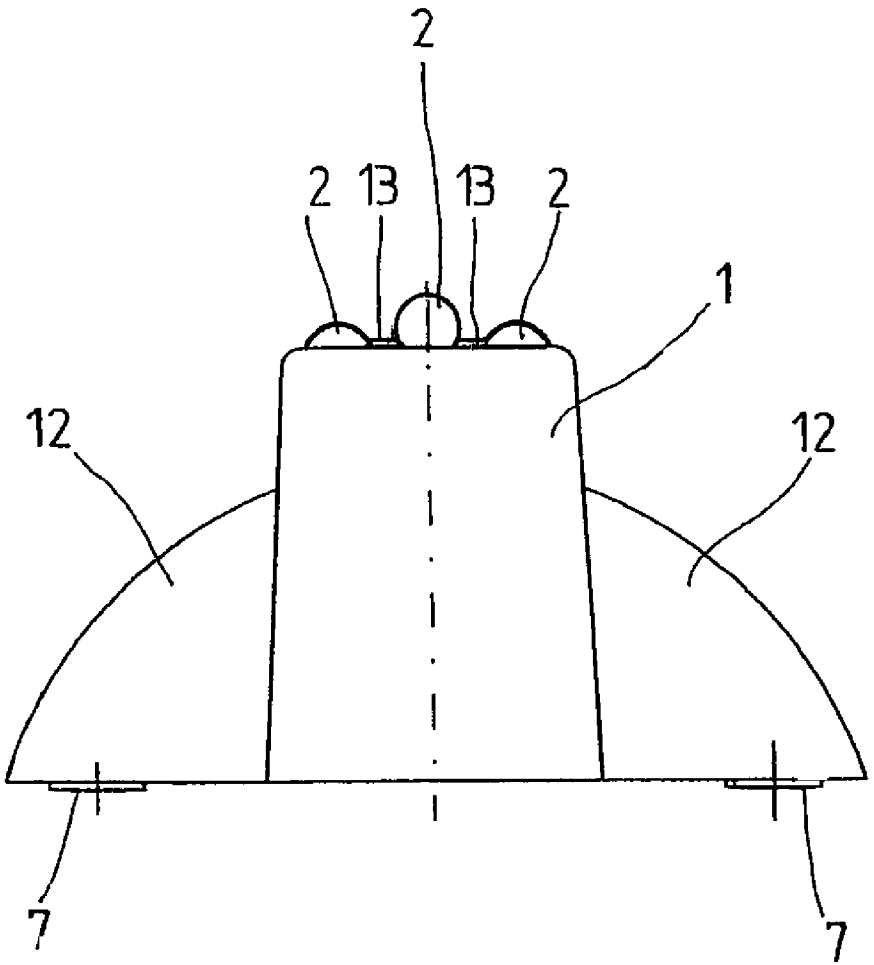
FIG. 12: Illustrates the knife sharpener in a third embodiment in elevation.

FIG. 12 shows the side view of another design of the knife sharpener in accordance with the present invention. The design in FIG. 12 is in essence very similar to that in FIG. 9, the main difference being that the middle of the three grinding elements 2 protrudes slightly more from housing 1 than the other two grinding elements 2, i.e. more than the left and right grinding elements 2 in FIG. 12. This arrangement of the grinding elements 2 is beneficial for the sharpening of a knife, a pair of scissors or such, if the blade of which is sharpened with grinding element 2, which is higher than the other two grinding elements 2, in a direction towards one of the other, lower grinding elements 2. An alternative configuration can allow for the individual grinding elements 2 to be arranged at different heights, for example, so that they are arranged to look like steps. If more than three grinding elements 2 are used, for example four, the design can allow for the two grinding elements 2 that are in the middle to be elevated above the two outer grinding elements 2.

Incidentally, all grinding elements 2 in the aforementioned designs can have different surfaces. The design can particularly allow for the surfaces of the grinding elements 2 differing in their roughness, material, abrasion resistance and such. For example, the design shown in FIGS. 9 and 12 can allow for the middle grinding element 2 having a coarse and therefore rougher surface than the two adjacent grinding elements 2. Furthermore, it is possible for one grinding element 2 alone to have different surface areas with different surface characteristics in longitudinal direction.

The designs showed in FIGS. 1 to 11 are not to scale.

The invention claimed is:

1. Manual knife sharpener, comprising:

a housing which has a surface designed to be a base; and a longitudinal, primarily cylindrical grinding element made from ceramics, said grinding element including two end -faces disposed perpendicularly to a longitudinal extent of said grinding element, and at least part of a surface of said grinding element being arranged on a surface of the housing opposite the base, wherein the base is designed at a right angle to a longitudinal line of the grinding element and the grinding element is positioned in the middle in relation to a projection of the base;

wherein the grinding element is arranged rotary, so that it can be rotated while the knife sharpener is not in use, wherein the grinding element is arranged between retaining arms constructed at longitudinal ends of said housing, said grinding element removeably contacting and attaching to each of said arms via said end faces, and both of said end faces being at least partially visible while in contact with said arms.

2. The knife sharpener according to claim 1, wherein the grinding element is pivoted.

3. The knife sharpener according to claim 1, wherein the housing is an injection-molded plastic housing.

4. The knife sharpener according to claim 1, wherein anti-slip bases are arranged on at least corners of the base.

5. The knife sharpener according to claim 1, wherein the grinding element is mounted on a housing-side support.

6. The knife sharpener according to claim 1, wherein the grinding element is respectively inserted endwise into a housing-side receiver.

7. The knife sharpener according to claim 6, wherein the grinding element is arranged movably in the receiver and is pushed by springs in a direction of an external surface.

8. The knife sharpener according to claim 1, further comprising a plurality of said grinding elements arranged primarily parallel to one another.

9. The knife sharpener according to claim 1, wherein the grinding element is covered by a detachable protective cap.

10. The knife sharpener according to claim 9, wherein the protective cap is inserted into housing apertures with plugs.

11. The knife sharpener according to claim 1, wherein the grinding element is constructed as a hollow cylinder.

12. Manual knife sharpener, comprising:

a housing which has a surface designed to be a base; and at least two longitudinal, primarily cylindrical grinding elements made from ceramics, at least part of a surface of the at least two grinding elements being arranged on a surface of the housing opposite the base, wherein the base is designed at a right angle to a longitudinal line of the at least two grinding elements; and at least one spacer disposed between said at least two grinding elements, each of said at least one spacers being in contact with two of said at least two grinding elements.

* * * * *